US005601403A

United States Patent [19]

Galbraith et al.

[11] Patent Number: 5,601,403

[45] Date of Patent: Feb. 11, 1997

[54] APPARATUS AND METHODS FOR MODIFYING A TURBINE DIAPHRAGM FOR USE WITH A REDUCED ROTOR LAN DIAMETER

[75] Inventors: Shawn W. Galbraith, Scotia; William V. Coll, Niskayuna; Dennis R. Ahl, Sprakers; Keith E. Seconde, Schenectady, all of N.Y.

[73] Assignee: General Electric Co., Schenectady, N.Y.

[21] Appl. No.: 472,577

[22] Filed: Jun. 7, 1995

Related U.S. Application Data

[62] Division of Ser. No. 304,908, Sep. 13, 1994.

[51] Int. Cl.[6] ..... F01D 5/00

[52] U.S. Cl. ..... 415/173.6; 415/173.7

[58] Field of Search ..... 415/173.6, 173.7, 415/174.5, 209.1

[56] References Cited

U.S. PATENT DOCUMENTS

| | | | |
|---|---|---|---|
| 2,336,323 | 12/1943 | Warren | 415/173.6 |
| 2,410,588 | 11/1946 | Phelan et al. | 415/173.6 |
| 3,386,155 | 6/1968 | Jenkinson . | |
| 3,429,557 | 2/1969 | Brandon et al. | 415/173.7 |
| 4,606,102 | 8/1986 | Reithmuller . | |
| 4,924,581 | 5/1990 | Jakobsen . | |
| 5,031,311 | 7/1991 | Comensoli . | |
| 5,049,032 | 9/1991 | Brandon | 415/173.7 |
| 5,205,465 | 4/1993 | Bogard et al. . | |
| 5,271,712 | 12/1993 | Brandon | 415/173.7 |

FOREIGN PATENT DOCUMENTS

| | | | |
|---|---|---|---|
| 767656 | 2/1957 | Germany | 415/173.6 |
| 1306 | 1/1985 | Japan | 415/173.6 |

*Primary Examiner*—John T. Kwon
*Attorney, Agent, or Firm*—Nixon & Vanderhye

[57] ABSTRACT

The diaphragm modification includes providing ring segments having radial outward projecting tenons for reception in dovetail grooves of the diaphragm bore. Seal strips extend about the outer face of the segment rings for engaging the diaphragm bore and crush pins are disposed around the sides of the tenons to provide close tolerance fit between the dovetail hooks of the diaphragm, thus accommodating any out-of-roundness or eccentricity of the diaphragm extant through prior use. Bolts are applied in tapped openings of the segment rings and diaphragm to facilitate securement of the segment rings and diaphragm and the segments 34 are seal-welded to the diaphragm. New packing ring segments are provided in the dovetail grooves along the radial inner face of the segment rings to complete the stage sealing between the diaphragm and reduced diameter rotor.

4 Claims, 2 Drawing Sheets

Fig. 2
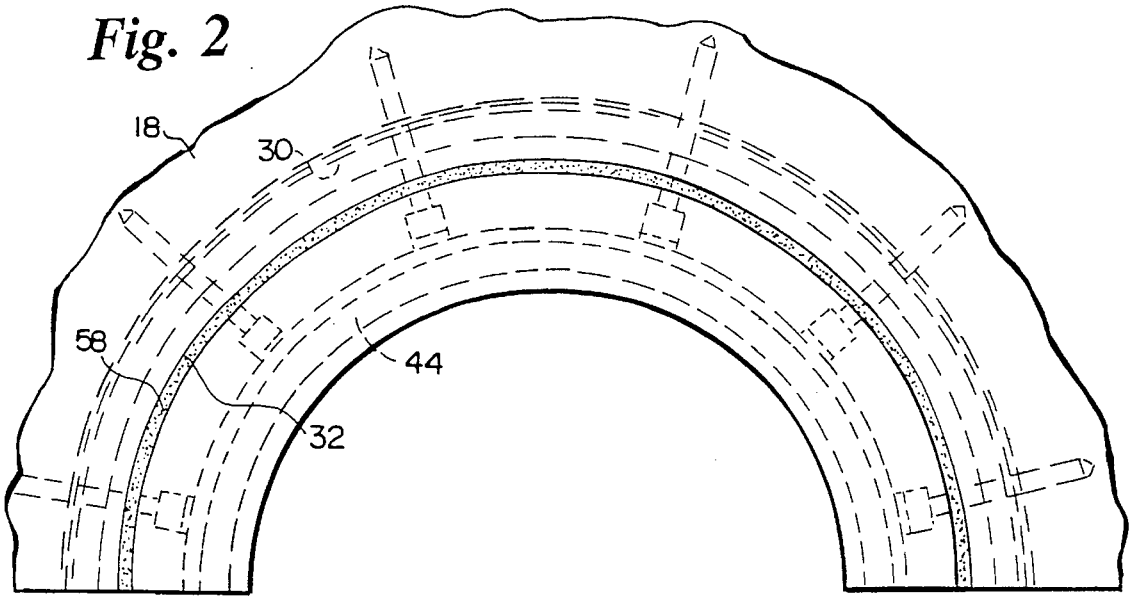
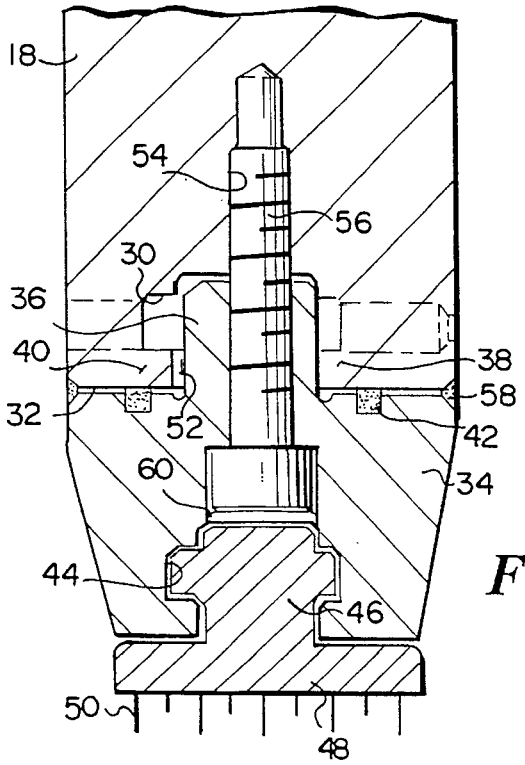
Fig. 3

APPARATUS AND METHODS FOR MODIFYING A TURBINE DIAPHRAGM FOR USE WITH A REDUCED ROTOR LAN DIAMETER

This is a divisional of co-pending application Ser. No. 08/304,908, filed on Sep. 13, 1994.

TECHNICAL FIELD

The present invention relates to apparatus and methods for modifying a turbine diaphragm, particularly a steam turbine diaphragm, for use with a reduced rotor LAN diameter, and particularly to apparatus and methods for replacing the existing packing ring segment about the diaphragm bore with a combined segment ring and packing ring segment to complete the gap between the diaphragm bore and the reduced rotor LAN diameter and form a seal.

BACKGROUND

When replacing existing turbine rotors, it is often necessary in the design of the new rotor to change the torsional frequency response. Various constraints, however, are often imposed requiring larger frequency windows with respect to a new rotor train. As a result, detuning of the rotor train may be required. Thus, material is frequently added to or removed from a rotor to achieve a certain frequency response and to move that frequency response to a desired frequency. The detuning process, however, may cause an increase or a reduction in the rotor LAN diameters. A reduction in the rotor LAN diameters is difficult to accommodate in existing diaphragms at the turbine installation site, especially in nuclear power plants because of the need for radiation protection. That is, upon reduction of the rotor LAN diameter, the stage sealing in the existing turbine would be lost unless measures are taken to restore the seal. A reduction in the rotor LAN diameter, for example, on the order of 2–4 inches, would result in a spacing of the existing packing ring segment from the rotor LAN, effectively forming an annular gap between the segment and the rotor LAN. The packing ring segment, of course, provides a seal between axial opposite sides of the stage and typically forms with the rotor LAN a labyrinth-type seal along its radially innermost surface. While the restoration of the stage seal can be accomplished by supplying a new stage diaphragm having an appropriately reduced diametrical bore, this is undesirable due to cost constraints and cycle time to manufacture and replace the old diaphragm with the new diaphragm. The existing stage diaphragm is therefore frequently modified under these conditions.

A typical modification to an existing turbine stage diaphragm includes building up weld material along the interior of the diaphragm bore. This technique is used where machinery can be brought to the installation site or the diaphragm can be transported to a facility capable of performing the modification. However, this technique is labor-intensive, contributes significantly to turbine outage time and costly.

DISCLOSURE OF THE INVENTION

According to the present invention, there is provided apparatus and methods for restoration of stage sealing of a turbine diaphragm with modification to the existing stage diaphragm to accommodate a reduction in rotor LAN diameter. The present invention involves use of pre-machined segment rings, new packing ring segments, and common hardware pieces together with minimal welding to restore stage sealing with respect to a new reduced rotor LAN diameter. More particularly, the present invention provides a plurality of segment rings fabricated to appropriate dimensions and tolerances according to the diaphragm bore of that stage in an existing turbine and the new rotor LAN diameter. Each arcuate segment ring includes a radially outwardly projecting tenon circumferentially extending along its radial outer face and a circumferentially extending dovetail groove formed along its radial inner face. The dovetail groove along the inner face accommodates a projecting dovetail of a new packing ring segment, which preferably mounts labyrinth seal teeth for completing the seal as discussed hereafter. As will be appreciated, the existing diaphragm bore has a radially inwardly opening dovetail-shaped groove for receiving the dovetails of the packing ring segments extant in the turbine undergoing modification. Those packing ring segments form a labyrinth seal with the existing rotor and are therefore of a specified diameter. They cannot therefore be used to span the radial gap between the diaphragm bore and the LAN of the new rotor because of the reduction in the rotor LAN diameter. Thus, by making use of segment rings in combination with new reduced diameter packing ring segments in accordance with the present invention, the radially increased gap between the diaphragm bore and the reduced rotor LAN diameter can be accommodated.

Further, it will also be appreciated that the diaphragm bore, including its dovetail groove, may be out-of-round, i.e., eccentric or egg-shaped, or may have various high and low surfaces as a result of thermal transients during long-term usage of the turbine. Additionally, the hooks of the dovetail groove may likewise be out-of-round and have various high and low spots. It is important to accommodate these eccentricities in both the hooks as well as the diaphragm bore.

To accomplish the foregoing, a plurality of segment rings are fabricated and dimensioned to accommodate the diaphragm bore and the new rotor LAN diameter. As noted previously, each segment ring has a tenon along its outer face and a dovetail groove along its inner face for receiving the dovetail of a packing ring segment. To install this new stage seal, the existing packing ring segment is removed from the diaphragm, leaving the dovetail groove in the bore. The stage diaphragm dimensions and contours are then measured. Seal rings are provided along the radial outer faces of the segment rings and are preferably ground to accommodate any out-of-roundness or eccentricity of the diaphragm bore. Additionally, a plurality of crush pins are disposed, e.g., welded, along one side of the tenon of each segment ring. These crush pins are formed, e.g., machined, to accommodate any out-of-roundness or high and low areas of the opposed hooks of the dovetail groove in the diaphragm bore such that when the segment ring is applied to the diaphragm bore by inserting the tenon into the dovetail groove, the tenons and formed crush pins will form a close tolerance fit between the diaphragm hooks. With the seal rings and crush pins properly formed, the segment rings are inserted into the diaphragm bore and tack-welded in place on both admission and discharge sides. Radial bolt holes are drilled and tapped at circumferentially spaced positions about the segment rings into the diaphragm bore. Bolts are inserted into the holes for securing the segment rings to the diaphragm. The juncture of the segment rings and the diaphragm bore are then welded along the admission and discharge sides to seal the segment rings to the diaphragm. Additionally, the bolt heads are seal-welded to prevent leakage. The new packing ring segments, either of a conventional or reroundable type, are then inserted into the dovetail groove of the segment rings to complete the radial gap between the diaphragm bore and the rotor LAN diameter.

It will be appreciated that the present invention enables the fitting up of the reduced rotor LAN diameter to the existing diaphragm bore at the installation site with reduced machining time, cost savings, particularly associated with not having to replace existing diaphragms, and reduced turbine outage, while retaining the ability to accommodate eccentric or out-of-roundness of the diaphragm bore and hooks. Minimized welding is also achieved.

In a preferred embodiment according to the present invention, there is provided a method of modifying a turbine diaphragm having a bore to accommodate a reduced diameter rotor comprising the steps of providing at least one segment ring having a dovetail formed along an inner face thereof and dimensioned to in part complete a radial gap between the diaphragm bore and the reduced diameter rotor, forming at least one seal strip to accommodate variations about the diaphragm bore from an arc of a circle, locating one seal strip between one segment ring and the inner bore, securing one segment ring to the diaphragm with one seal strip therebetween and coupling a packing ring segment in the dovetail along one segment ring to complete the radial gap and afford a seal with the reduced diameter rotor.

In a further preferred embodiment according to the present invention, there is provided a method of modifying a turbine diaphragm having a dovetail with opposed hooks recessed along a radial inner bore thereof to accommodate a reduced diameter rotor, comprising the steps of providing at least one segment ring having a dovetail formed along an inner face thereof and dimensioned to in part complete a radial gap between the diaphragm bore and the reduced diameter rotor, the one segment ring having a tenon projecting radially outwardly from an opposite face thereof, providing a surface along one side of the tenon, forming the surface to provide, upon reception of the tenon and surfaces between the hooks, a close tolerance fit between the segment ring and the diaphragm hooks and securing the one segment ring to the diaphragm.

In a still further preferred embodiment according to the present invention, there is provided a turbine diaphragm for accommodating a rotor, comprising a diaphragm body having a radially inner bore and an inwardly recessed dovetail, at least one segment ring having a dovetail formed along an inner face thereof and dimensioned to in part complete a radial gap between the diaphragm bore and the reduced diameter rotor, the one segment ring having a tenon projecting radially outwardly from an outer face thereof and received within the inwardly recessed dovetail on the diaphragm body, at least one seal strip disposed along the outer face of the one segment ring and shaped along a radially outer surface to substantially follow the contour of the diaphragm bore face such that the circular segment ring fits about the bore and means for securing the one segment ring to the diaphragm body.

Accordingly, it is a primary object of the present invention to provide novel and improved apparatus and methods for modifying existing turbine diaphragms to facilitate replacement of stage sealing where rotors having reduced rotor LAN diameters are employed in the modified diaphragm.

BRIEF DESCRIPTION OF THE DRAWINGS

FIG. 2 is a fragmentary longitudinal elevational view of a radially innermost portion of the diaphragm and segment ring; and FIG. 3 is an enlarged cross-sectional view illustrating the modified sealing stage according to the present invention.

BEST MODE FOR CARRYING OUT THE INVENTION

Figure 1:
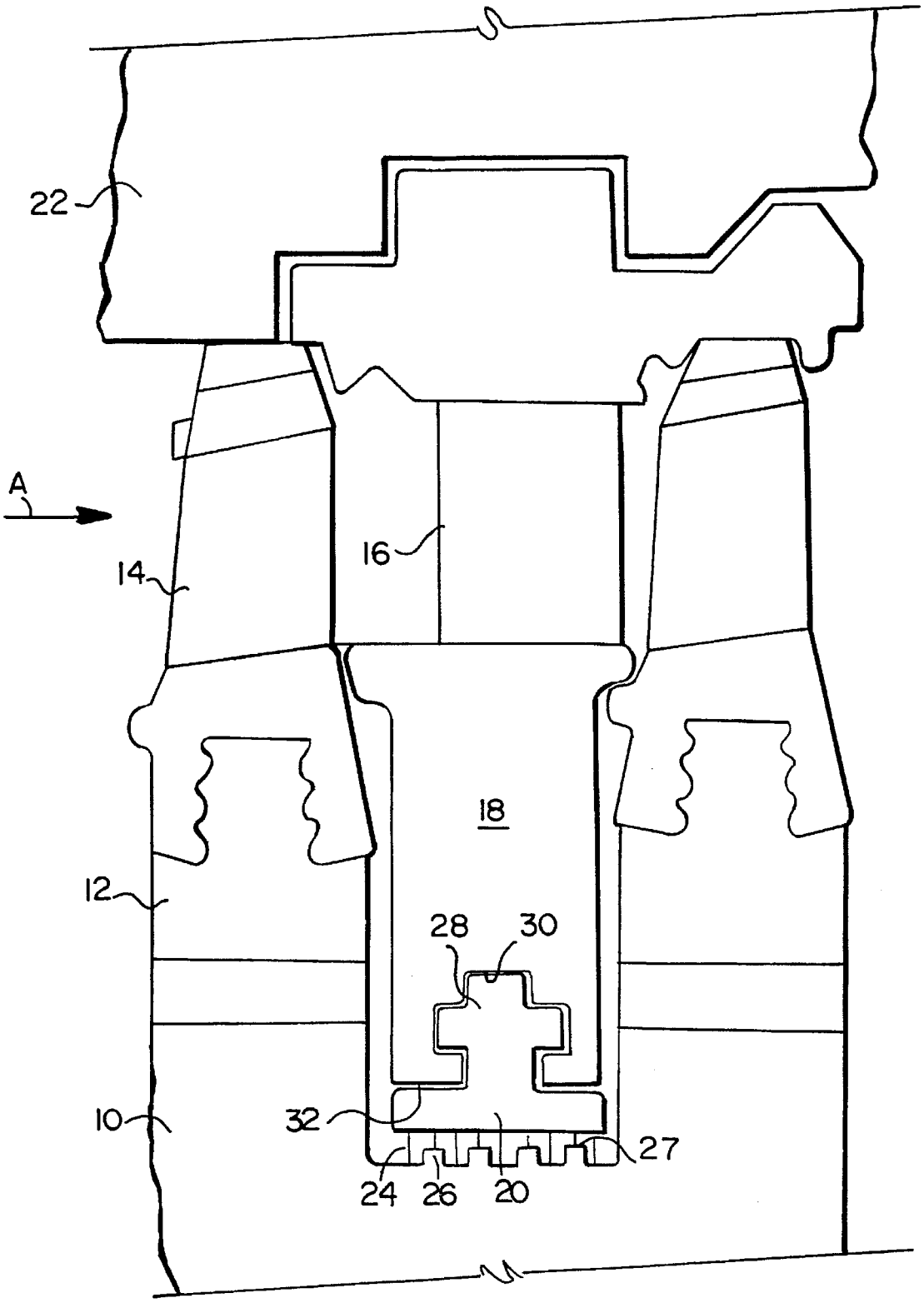
FIG. 1 is a schematic illustration of a conventional turbine stage illustrating the diaphragm and packing ring segment and rotor.

Referring now to FIG. 1, there is schematically illustrated a portion of a turbine including a rotor 10, carrying rotor wheels 12 mounting turbine buckets 14 and axially between which is located a stage including fixed stator vanes 16, a diaphragm 18 and packing ring segments 20. The stator vanes 16 are fixed to the inner shell 22 of the turbine and carry the diaphragm and packing ring segments 20. As is conventional, the gas, for example, steam, for driving the turbine flows through the buckets and stator vanes in a direction, e.g., indicated A in FIG. 1. In this conventional turbine construction, a labyrinth seal is provided between the packing ring segments 20 and rotor 10. The labyrinth seal includes a plurality of teeth 24 carried by the segments 20 and which teeth are closely spaced relative to a plurality of axially spaced radial projections or ribs 26 on a LAN diameter 27 whereby flow between the opposite sides, the admission and discharge sides, of the stage is minimized. The packing ring segments 20 are typically provided with radially outwardly directed dovetails 28 for reception in dovetail-shaped grooves 30 along the radially inner face of diaphragm 18.

As described previously, when a steam turbine rotor is replaced with a new rotor and the latter is detuned, oftentimes necessitating a reduction in its LAN diameter, it will be appreciated that the gap between the diaphragm bore 32 and the rotor is increased such that the existing labyrinth seal between the packing ring segment 20 and rotor 10 is rendered ineffective to seal between opposite sides of the stator stage 18. Consequently, absent replacing diaphragm 18 with a new diaphragm accommodating the reduction in rotor LAN diameter, a new sealing stage design is necessary to restore the seal between the diaphragm and rotor.

Referring now to FIGS. 2 and 3, the existing diaphragm 18 with its dovetail groove 30 and bore 32 are illustrated. However, in lieu of the packing ring segment 28 illustrated in FIG. 1 which seals between the diaphragm bore and the rotor, a plurality of segment rings 34 in combination with new reduced diameter packing ring segments 48 are provided to seal between the existing diaphragm and the rotor with the reduced diameter LAN. Particularly, the segment rings and packing ring segments 28 complete the enlarged radial gap between the diaphragm bore and the labyrinth seal projections 26 on the new reduced diameter rotor LAN. Consequently, in accordance with the present invention, a plurality of segment rings 34 are fabricated according to the known dimensions for disposition between the extant diaphragm bore 32 and the reduced diameter rotor LAN to complete this gap in conjunction with new packing ring segments 48.

More particularly, the segment rings 34 may be provided in discrete circular lengths, for example, 12 segment rings each 30° in circumferential extent may be provided. Each segment ring 34 includes a tenon 36 formed along its radial outer face for reception in the dovetail groove 30 of the existing diaphragm bore and particularly between the hooks 38 and 40 of the dovetail groove 30. Grooves are also formed along the outer face of the segment rings 34 to accommodate arcuate sealing strips 42. The opposite face, i.e., the radially inner face, of segment rings 34, is provided with a dovetail-shaped groove 44 for receiving the dovetail 46 of the new packing ring segments 48. Packing ring segments 48 include teeth 50 along the radial inner surface thereof, forming part of the labyrinth seal for the reduced rotor LAN diameter. Thus, the increased radial gap is accommodated by the combination of the segment rings and packing ring segments.

To install these modifications in an existing diaphragm, the segment rings 34 are fabricated in accordance with the predetermined dimensions of the diaphragm bore and the reduced rotor LAN diameter. It will be appreciated, however, that the diaphragm bore, including the hooks 38 and 40, may be eccentric or out-of-round or have other variations in its surfaces as a result of long-term usage, particularly as a result of thermal transients. These out-of-round variations, eccentricities, bumps or depressions can be accommodated by forming the outer surfaces of the sealing strips 42 to conform to these bore surface variations. The out-of-roundness or eccentricity of the hooks may also be accommodated by providing a surface along the side of the tenon 36 that can be formed such that the tenon and the surface are closely toleranced to the axial distance between the hooks 38 and 40, The surface may comprise a plurality of crush pins 52 disposed along the side of the tenon at circumferentially spaced positions therealong.

Once the appropriate fits have been made, each segment ring 34 is inserted into the diameter bore. Particularly, the tenons 36 are received in the dovetail grooves 30 of the diaphragm bore 32 (usually only one-half of the bore at a time is refurbished) with the seal strips 42 butting the inner face of the bore, the crush pins engaging the hook 40, and the opposite side of the tenon engaging the opposite hook 38. These segments are preferably tack-welded in place along both the admission and discharge sides. Once in place, holes 54 are drilled and tapped at predetermined positions along the segment rings 34 and into the diaphragm 18. Bolts 56 are then inserted into the bores and appropriate torque applied to secure the segment rings 34 to the diaphragm 18. Welds 58 are then formed along the admission and discharge sides at the juncture of the segment rings 34 and diaphragm 18 to seal the joint therebetween. Additionally, the bolts 56 are seal-welded, as illustrated at 60, 360° about the bolt heads. The new packing ring segments 48 are then inserted into the dovetail groove 44 of the segment rings 34 similarly as they would have been inserted into the dovetail of the diaphragm in a new turbine installation.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A turbine diaphragm for accommodating a rotor, comprising:

a diaphragm body having a radially inner bore and an inwardly recessed dovetail;

at least one segment ring having a dovetail formed along an inner face thereof and dimensioned to in part complete a radial gap between the diaphragm bore and the reduced diameter rotor, said one segment ring having a tenon projecting radially outwardly from an outer face thereof and received within the inwardly recessed dovetail on the diaphragm body, at least one seal strip disposed along said outer face of said one segment ring and shaped along a radially outer surface to substantially follow the contour of the diaphragm bore face such that the circular segment ring fits about the bore; and means for securing the one segment ring to the diaphragm body.

2. A diaphragm according to claim 1 wherein said securing means includes bolts.

3. A diaphragm according to claim 1 wherein said securing means includes welds between adjoining surfaces of said one segment ring and said diaphragm body.

4. A diaphragm according to claim 1 including a plurality of crush pins located along one side of said tenon, said crush pins being formed to provide a close tolerance fit between the hooks of the dovetail on the diaphragm body.

* * * * *